US007420182B2

(12) United States Patent
Hruby et al.

(10) Patent No.: US 7,420,182 B2
(45) Date of Patent: Sep. 2, 2008

(54) COMBINED RADIO FREQUENCY AND HALL EFFECT ION SOURCE AND PLASMA ACCELERATOR SYSTEM

(75) Inventors: Vladimir Hruby, Newton, MA (US); Kurt Hohman, Framingham, MA (US); Thomas Brogan, Lakewood, CO (US)

(73) Assignee: Busek Company, Natick, MA (US)

( * ) Notice: Subject to any disclaimer, the term of this patent is extended or adjusted under 35 U.S.C. 154(b) by 377 days.

(21) Appl. No.: 11/412,619

(22) Filed: Apr. 27, 2006

(65) Prior Publication Data

US 2006/0284562 A1 Dec. 21, 2006

Related U.S. Application Data

(60) Provisional application No. 60/675,426, filed on Apr. 27, 2005.

(51) Int. Cl.
*H01J 27/00* (2006.01)

(52) U.S. Cl. ..... 250/427; 250/492.21; 250/251; 315/111.61; 315/111.51; 315/111.71; 315/111.41; 315/501; 204/298.04; 204/298.03; 204/298.08; 204/298.06; 313/359.1; 313/231.31; 313/361.1; 313/362.1; 118/731 I; 60/202

(58) Field of Classification Search ..... 250/427, 250/492.21, 251; 315/111.61, 111.51, 111.71, 315/111.41, 501; 204/298.04, 298.03, 298.08, 204/298.06; 313/359.1, 231.31, 361.1, 362.1; 60/203.1, 202, 204; 118/723 I
See application file for complete search history.

(56) References Cited

U.S. PATENT DOCUMENTS 5,581,155 A * 12/1996 Morozov et al. ..... 315/111.21
5,859,428 A * 1/1999 Fruchtman ..... 250/251
6,075,321 A 6/2000 Hruby
6,150,764 A 11/2000 Hruby et al.
6,293,090 B1 * 9/2001 Olson ..... 60/203.1
6,486,593 B1 * 11/2002 Wang et al. ..... 313/231.31
6,834,492 B2 12/2004 Hruby et al.
2003/0184205 A1 * 10/2003 Johnson ..... 313/359.1

OTHER PUBLICATIONS

U.S. Appl. No. 11/301,857, filed Dec. 13, 2005, Hruby et al.

* cited by examiner

*Primary Examiner*—Jack I. Berman
*Assistant Examiner*—Meenakshi S Sahu
(74) *Attorney, Agent, or Firm*—Iandiorio Teska & Coleman

(57) ABSTRACT

This invention features a combined radio frequency (RF) and Hall Effect ion source and plasma accelerator system including a plasma accelerator having an anode and a discharge zone, the plasma accelerator for providing plasma discharge. A gas distributor introduces a gas into the plasma accelerator. A cathode emits electrons attracted to the anode for ionizing the gas and neutralizing ion flux emitted from the plasma accelerator. An electrical circuit coupled between the anode and the cathode having a DC power source provides DC voltage. A magnetic circuit structure including a magnetic field source establishes a transverse magnetic field in the plasma accelerator that creates an impedance to the flow of the electrons toward the anode to enhance ionization of the gas to create plasma and which in combination with the electric circuit establishes an axial electric field in the plasma accelerator. An RF power source provides RF power to at least one electrode disposed about and/or inside the plasma accelerator that induces current for ionizing the gas to create the plasma such that the axial electric field accelerates ions through the plasma accelerator to provide ion flux.

22 Claims, 7 Drawing Sheets

COMBINED RADIO FREQUENCY AND HALL EFFECT ION SOURCE AND PLASMA ACCELERATOR SYSTEM

RELATED APPLICATIONS

This application claims benefit of and priority to U.S. Provisional Application Ser. No. 60/675,426 filed Apr. 27, 2005, incorporated by reference herein.

FIELD OF THE INVENTION

This invention relates to a combined radio frequency (RF) and Hall Effect ion source and plasma accelerator system.

BACKGROUND OF THE INVENTION

Conventional Hall Effect ion source and plasma systems typically include a plasma accelerator, a gas distributor for introducing a gas into the plasma accelerator, and an anode located at one end of a channel. A DC voltage provided by a DC power source connected to an electric circuit creates an electric potential between the anode and a floating externally located cathode that emits electrons. A magnetic circuit structure with a magnetic field source, e.g., one or more permanent magnet or electromagnetic coil, creates a transverse magnetic field. The electric circuit and the magnetic circuit structure establish an axial electric field. The transverse magnetic field presents an impedance to flow of electrons attracted to the anode. As a result, the electrons spend most of their time drifting azimuthally (orthogonally) due to the transverse magnetic field. The result is the electrons collide with and ionize the neutral atoms in the propellant or gas. The collisions create positively charged ions in the gas to create plasma. The ions are accelerated by the axial electric field to create an ion flux that may be used, inter alia, to create thrust. See e.g., U.S. Pat. Nos. 6,150,764, 6,075,321, and 6,834,492 and U.S. patent application Ser. No. 11/301,857 filed Dec. 13, 2005, all by one or more common inventors hereof and the same assignee, and are incorporated in their entity by reference herein.

Conventional Hall Effect ion source and plasma accelerator systems rely on the DC voltage provided by the DC power source connected to the electric circuit in order to determine the strength of the axial electric field and therefore the acceleration and energy level of the ions in the plasma. The DC voltage level also affects the flow and energy level of electrons attracted to the anode and therefore the ionization of the gas to create plasma. The result is ionization and acceleration are closely coupled causing the system to have a smaller operating envelope and lower efficiency than may be possible if the processes could be separated. Coupling acceleration and ionization prevents separately "tuning" the ion energy level, the amount of ionization provided by the system, and the total flux of the ions. Therefore, conventional Hall Effect ion source and plasma accelerator systems are unable to efficiently generate ion flux with ions having low (e.g., <10 eV) or mid ion energy (e.g., <130 eV) levels while maintaining a constant high ion flux density.

Conventional Hall Effect ion source systems are also limited by the maximum DC voltage that can be utilized because arcs are typically generated in the discharge region of the plasma accelerator at high DC voltages, typically greater than about 1,000 V. This limits the maximum DC voltage that can be employed and therefore the maximum specific impulse that can be achieved.

SUMMARY OF THE INVENTION

It is therefore an object of this invention to provide a combined radio frequency and Hall Effect ion source and plasma accelerator system.

It is a further object of this invention to provide such a system which decouples ionization and acceleration.

It is a further object of this invention to provide such a system which separately controls ionization and acceleration.

It is a further object of this invention to provide such a system which improves efficiency.

It is a further object of this invention to provide such a system which eliminates the need to depend on the DC voltage for ionization.

It is a further object of this invention to provide such a system which separately tunes the energy level of ions in the plasma and the amount of ionization.

It is a further object of this invention to provide such a system which provides a constant ionic flux density with variations in DC voltages.

It is a further object of this invention to provide such a system which can tune the ion energy level of ions while maintaining a constant high ion flux density.

It is a further object of this invention to provide such a system which provides low to mid energy level ions at a constant high ion flux density.

It is a further object of this invention to provide such a system which provides ion flux with ions having a narrow range of energy levels.

It is a further object of this invention to provide such a system which increases the maximum specific impulse.

It is a further object of this invention to provide such a system which increases the available thrust to power ratio at lower DC voltages.

It is a further object of this invention to provide such a system which efficiently ionizes a gas to create plasma.

The subject invention results from the realization that a combined radio frequency and Hall Effect ion source and plasma accelerator system that decouples ionization and acceleration to provide for separately controlling the amount of ionization and the acceleration and energy level of the ions in the ion flux is effected, in one example, with a plasma accelerator with an anode and a discharge zone for providing plasma discharge and a gas distributor which introduces a gas into the plasma accelerator. A cathode emits electrons that are attracted to the anode and neutralize ion flux emitted from the plasma accelerator. An electric circuit with a DC power source is coupled between the anode and the cathode. A magnetic circuit structure establishes a transverse magnetic field in the plasma accelerator to create an impedance to the flow of the electrons toward the anode to enable a high degree of ionization of the gas to create plasma and in combination with the electric circuit establishes an axial electric field in the plasma accelerator. An RF power source provides RF power to at least one electrode disposed about and/or in the plasma accelerator to induce current that ionizes the gas to create the plasma such that the axial electric field accelerates the ions through the plasma accelerator to provide ion flux. The DC voltage provided by DC source connected to the electric circuit is adjusted to determine the strength of the axial electric field to accelerate the ions through the plasma accelerator to tune the energy level of the ions in the ion flux. The RF power provided by RF power source is adjusted to control the amount of ionization and the ion density.

The subject invention, however, in other embodiments, need not achieve all these objectives and the claims hereof should not be limited to structures or methods capable of achieving these objectives.

This invention features a combined radio frequency (RF) and Hall Effect ion source and plasma accelerator system including a plasma accelerator having an anode and a discharge zone, the plasma accelerator for providing plasma discharge. A gas distributor introduces a gas into the plasma accelerator. A cathode emits electrons attracted to the anode for ionization of the gas and for neutralizing ion flux emitted from the plasma accelerator. An electrical circuit coupled between the anode and the cathode having a DC power source that provides DC voltage. A magnetic circuit structure including a magnetic field source that establishes a transverse magnetic field in the plasma accelerator and creates an impedance to the flow of the electrons toward the anode to enhance ionization of the gas to create plasma and which in combination with the electric circuit establishes an axial electric field in the plasma accelerator. An RF power source provides RF power to at least one electrode disposed about and/or inside the plasma accelerator that induces current for ionizing the gas to create the plasma such that the axial electric field accelerates ions through the plasma accelerator to provide ion flux.

In a preferred embodiment, the DC voltage provided by the DC power source and RF power provided by the RF power source may be adjusted to selectively control the amount of ionization and acceleration of the plasma. The ionization and acceleration of the plasma may be optimized by controlling the RF power provided by the RF power source and/or the DC voltage provided by the DC power source. The DC voltage provided by the DC power source may be adjusted to control acceleration of the ions. The DC voltage provided by the DC power source and the RF power provided by the RF power source may be adjusted to decouple ionization of the gas from acceleration of the ions. The DC voltage generated by the DC power source and RF power provided by RF power source may be adjusted to selectively control the energy level of ions and the ion flux density of the plasma. The RF power source may provide RF power that may be coupled to the plasma inductively and/or capacitively. The RF power source may provide RF power that may be coupled to the plasma by electron cyclotron resonance. The plasma accelerator may include at least first and second stages wherein the first stage may be powered by the RF power source and the second stage may be powered the DC power source such that most of the ionization occurs in the first stage and most of the acceleration occurs in the second stage. At least one electrode may include a coil and/or capacitive plates. The magnetic circuit structure may include at least one electrically resistive material for minimizing coupling of the RF power into the magnetic circuit structure. The magnetic circuit structure may be segmented to minimize RF power losses. The magnetic circuit structure may include at least one layer of highly conductive material for minimizing RF power losses. The axial electric field may accelerate the ions in the plasma accelerator to create thrust. The DC voltage provided by the DC source and the RF power provided by the RF power source may be adjusted to increase thrust to the power ratio. The DC voltage provided by the DC power source and the RF power provided by the RF power source may be adjusted to increase specific impulse. The DC voltage provided by the DC power source and the RF power provided by the RF power source may be adjusted to provide a specific impulse of about 1000 seconds at DC voltages of about 100 V DC while delivering a thrust to power ratio of about 0.1N/kW. The DC voltage provided by the DC power source and the RF power provided by the RF power source may be adjusted to provide low to mid energy level ions at high ion flux density. The low energy ions at the high ionic flux density may be used to simulate particle flux and energy level of an atmosphere at low altitude orbit. The low earth orbit atmosphere may include atomic oxygen. The low to mid energy level ions provided at the high ionic flux density may be used for semiconductor processing.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
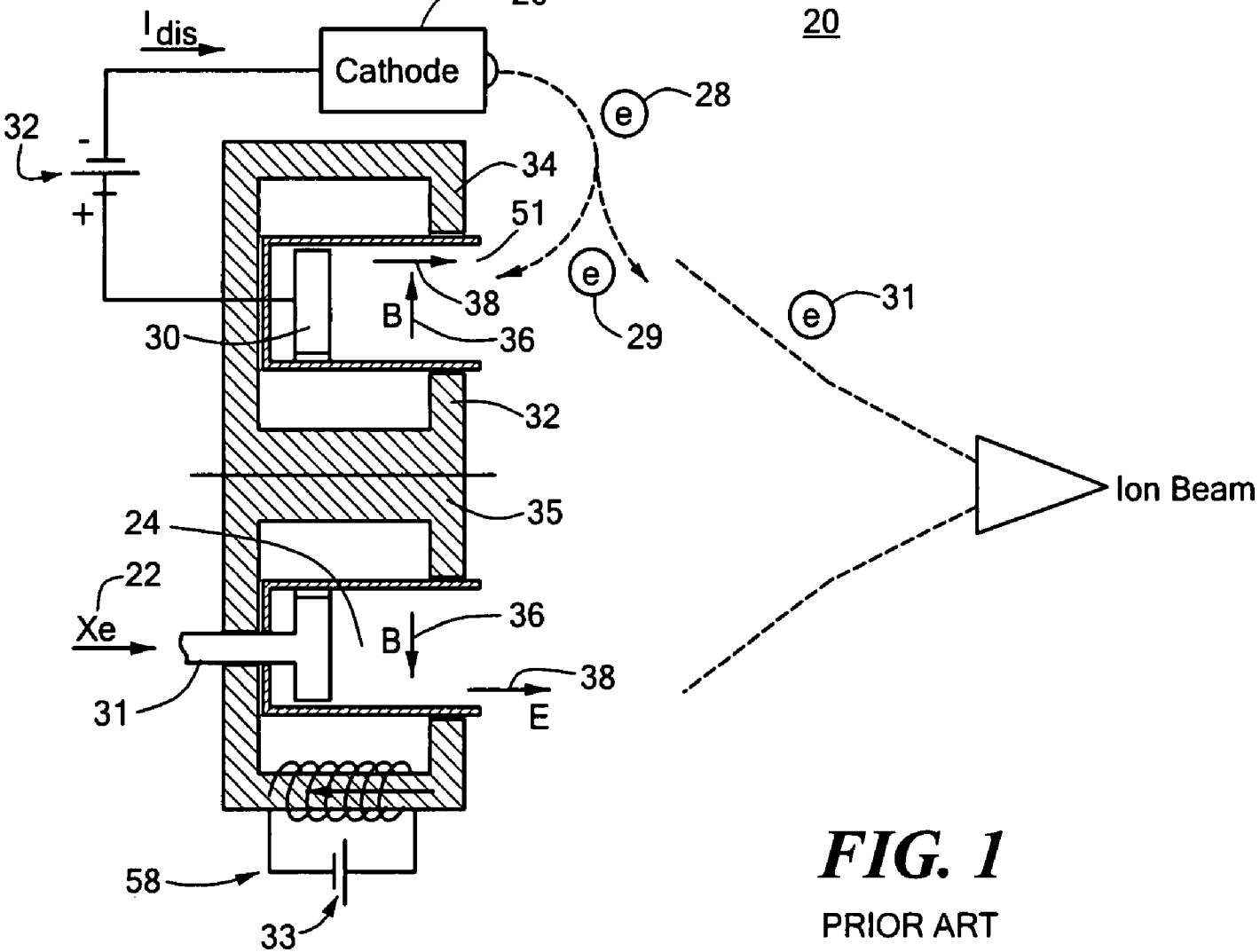
FIG. 1 PRIOR ART
FIG. 1 is a simplified, side sectional, schematic diagram of a typical prior art Hall Effect ion source and plasma accelerator system.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2:
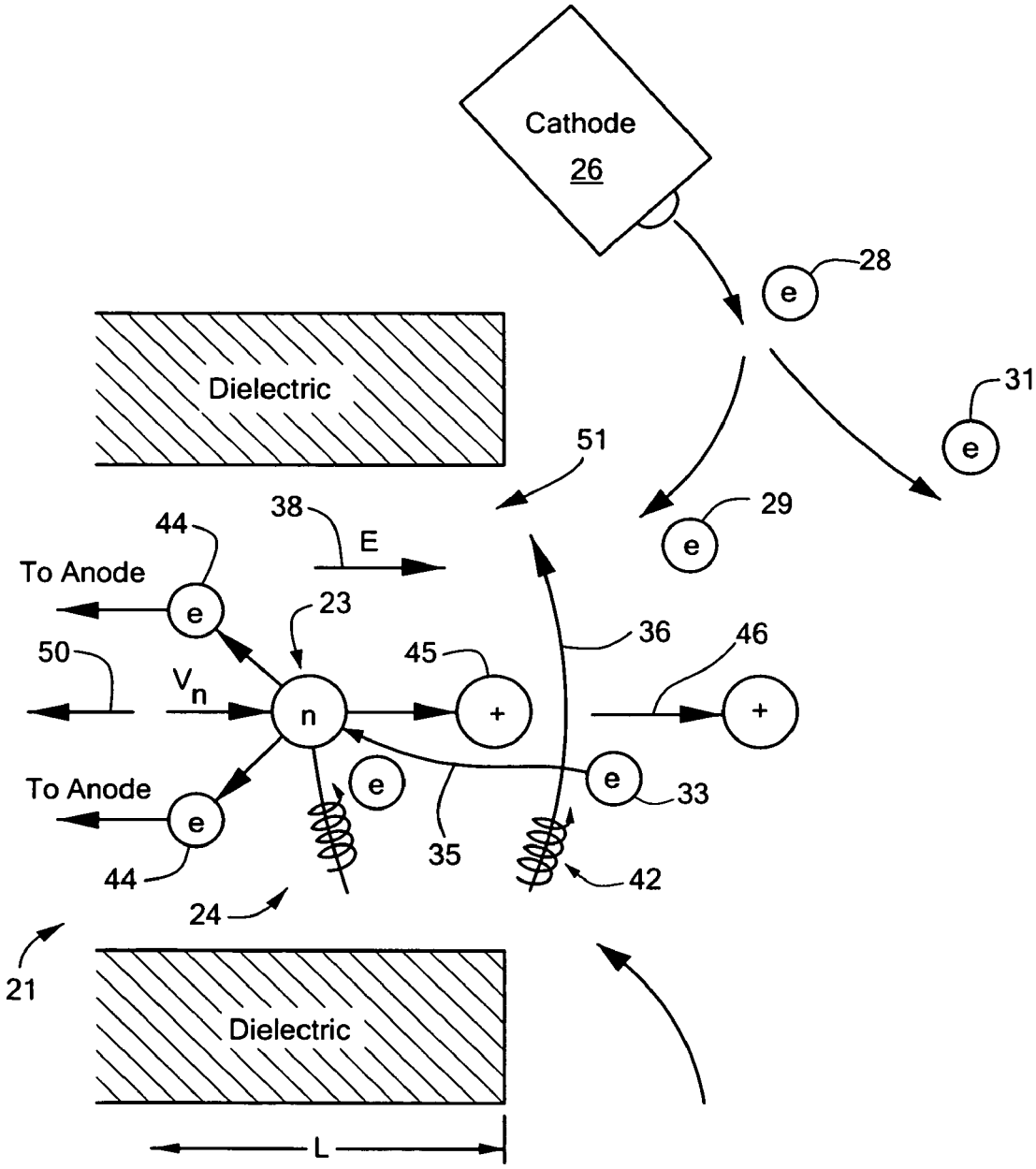
FIG. 2 PRIOR ART
FIG. 2 is an enlarged view of a portion of the prior art system shown in FIG. 1 illustrating the ionization of the propellant by electron impact and the interaction of the transverse magnetic and electric field that accelerates the propellant.

Conventional Hall Effect ion source and plasma accelerator system 20, FIG. 1, includes plasma accelerator 21 with discharge chamber 24, anode 30 and propellant or gas distributor 31 in discharge chamber 24 with transverse magnetic field (B) 36 and axial electric field (E) 38. Propellant 22, e.g., xenon or other gas depending on the application, is introduced through propellant distributor 31 into discharge chamber 24. System 20 also typically includes externally located cathode 26 which emits electrons, e.g., electrons 28, 29, and 31. Anode 30 located within the discharge chamber 24 attracts the electrons 28-31 emitted from cathode 26. DC voltages provided by electric circuit 32 in combination with magnetic circuit structure 35 create axial electric field 38. Magnetic circuit structure 35 with magnetic field source 58, e.g., an electromagnetic coil with electric circuit 33, or a permanent magnet (not shown) creates transverse magnetic field 36. Transverse magnetic field 36 provides an impedance to the flow of electrons 28-31 toward anode 30 which forces the electrons to travel in a helical fashion about the magnetic field lines associated with magnetic field 36, as shown at 42, FIG. 2

When the electrons trapped by magnetic field 36, e.g., electron 33, collide with propellant atoms, e.g., propellant atom 23, the collision creates positively charged ions, e.g., positively charged ion 45, by stripping one or more of electrons, e.g., electron 44 from the propellant atom to form plasma (ionization). The positively charged ions are rapidly accelerated from the discharge chamber 24 due to axial electric field 38, shown at 46 (acceleration), to generate ion flux that may be used, inter alia, to create thrust. As discussed in the Background section, the amount ionization of the gas to create plasma and the acceleration and energy level of the ions provided by system 20 is determined primarily by the DC voltages provided by electric circuit 32 causing ionization and acceleration to be closely coupled. At lower DC voltage, the potential between anode 30, FIG. 1 and cathode 26 decreases The strength of axial electric field 38 is reduced which reduces and the efficiency of the DC ionization and acceleration of ions from plasma accelerator 21. The net result is system 20 loses efficiency at lower DC voltages. Coupling ionization and acceleration prevents separately controlling the amount of ionization and acceleration of the ions which prevents tuning the energy level of the ions and the ion flux. Moreover, the maximum DC voltage that can be provided by electric circuit 32 is limited because at high DC voltages arcs are typically generated in discharge region 51 of plasma accelerator 21. This limits the maximum specific impulse, $I_{sp\ that}$ can be achieved. $I_{sp}$ is the impulse (change in momentum per unit mass flow of propellant). A high $I_{sp}$ means less propellant is needed for a given amount of momentum change. The higher the $I_{sp}$ the more efficiently a Hall Effect ion source and plasma accelerator system uses the propellant. This is especially useful when an ion source system is used to create thrust for satellites or other spacecraft where the amount of propellant is limited.

Figure 3:
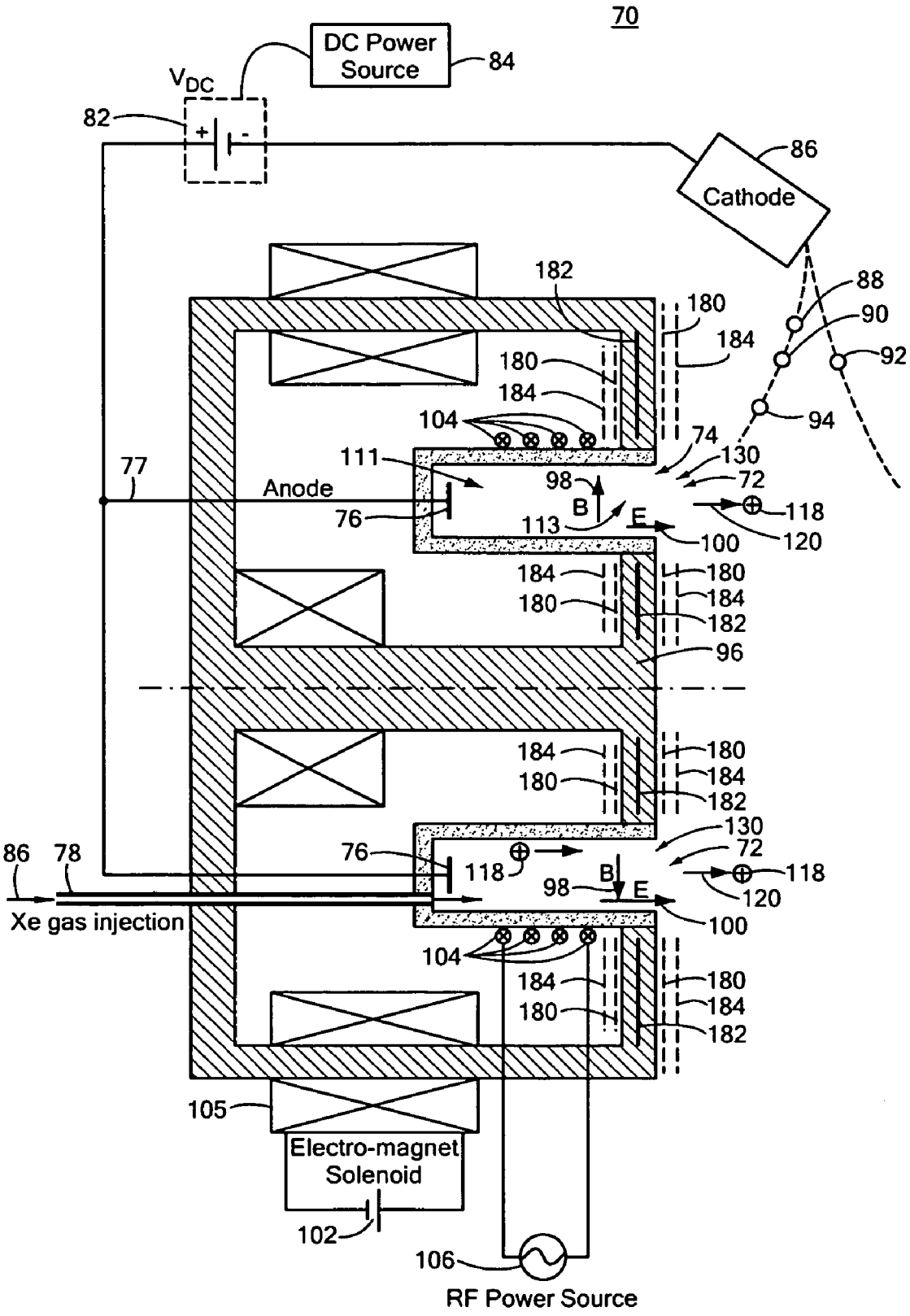
FIG. 3 is a schematic side view of one embodiment of a combined radio frequency and Hall Effect ion source and plasma accelerator system in accordance with this invention.

In contrast, combined radio frequency and Hall Effect ion source and plasma accelerator system 70, FIG. 3, of this invention includes plasma accelerator 72 with discharge zone 74 for providing plasma discharge. As used herein, radio frequency is any frequency in the range of about 1 KHz to about a hundred GHz. Propellant distributor 78 introduces a gas, e.g., xenon (Xe) or other gas, shown at 80, into plasma accelerator 72. Anode 76 is disposed in plasma accelerator 72 and is coupled to electric circuit 82 by line 77. Electric circuit 82 is coupled between cathode 86 and anode 76 and includes DC power source 84. DC power source 84 provides DC voltage to electric circuit 82 that polarizes the anode 76 positively and enables cathode 86 to emit electrons, e.g., electrons 88, 90, 92 and 94 that are attracted to anode 76. Electric circuit 82 and magnetic circuit structure 96 establish axial electric field (E) 100 in plasma accelerator 72. The DC voltage provided by DC power source 84 connected to electric circuit 82 is used to adjust the strength of axial electric field 100. Magnetic circuit structure 96 with a magnetic field source, e.g. electromagnetic coil or solenoid 105 with electric circuit 102, or a permanent magnet or similar type device (not shown), establishes transverse magnetic field (B) 98 in plasma accelerator 72. Transverse magnetic field 98 creates an impedance to the flow of electrons 88-94 toward anode 76 to enable efficient DC ionization of gas 80 to create plasma in plasma accelerator 72, similar as described above with reference to FIG. 2.

Figure 4:
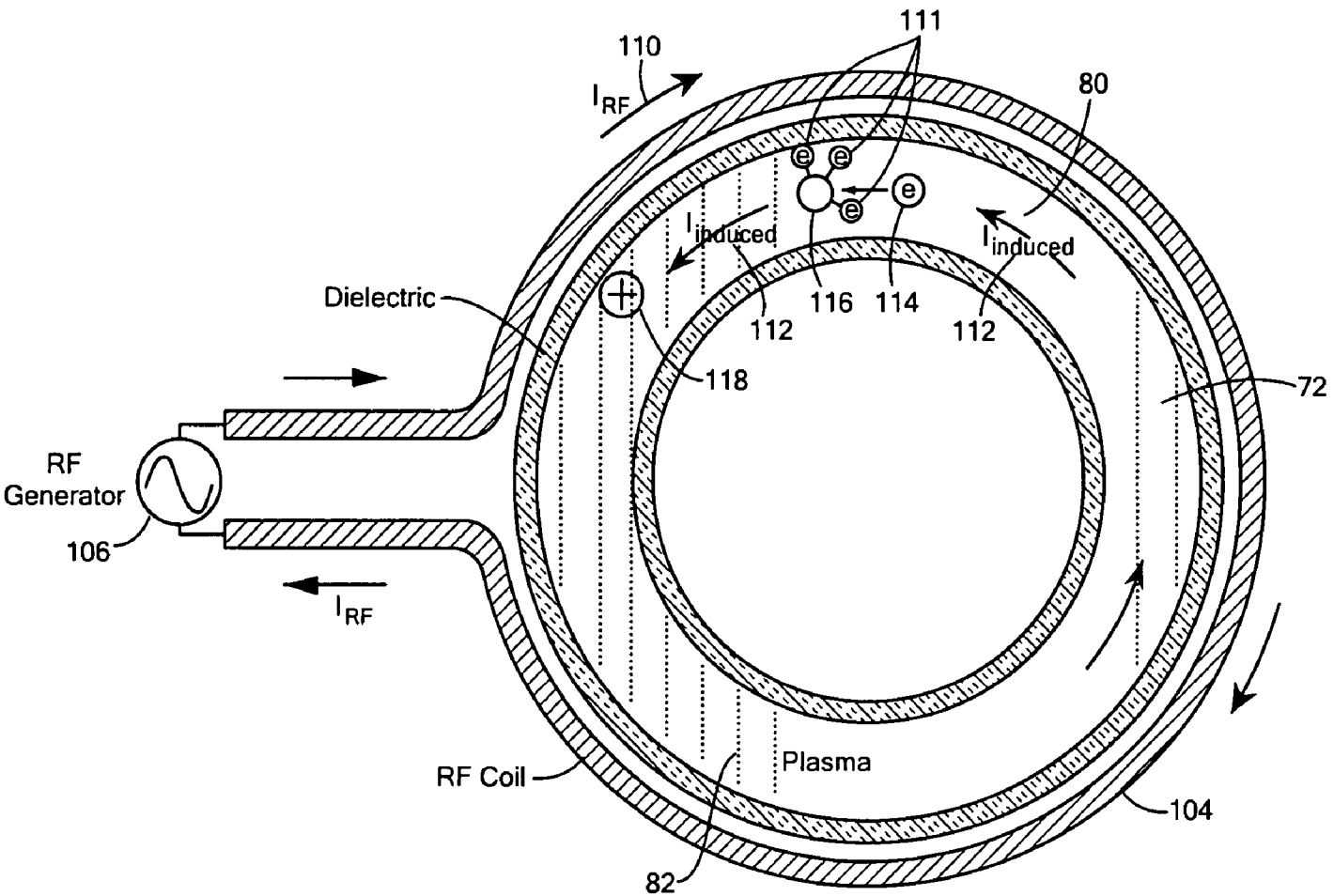
FIG. 4 is a schematic end view showing in further detail an example of the electrode shown in FIG. 3 disposed about the plasma accelerator.

To supplement or eliminate the need for the DC ionization and to decouple the ionization and acceleration process, system 70 includes RF power source 106 that provides RF power to at least one electrode, e.g., coil 104, that induces current for ionizing gas 80 to create plasma such that axial electric field 100 accelerates ions through plasma accelerator to provide ion flux. For example, coil 104, FIG. 4, is typically disposed about plasma accelerator 72. RF power source 106, e.g., an RF generator or similar type device, provides RF power to generate current $I_{RF}$-110 in coil 104. Current $I_{RF}$-110 induces current $I_{induced}$-112 in gas 80 in discharge chamber 72 to create positively charged ions in gas 80 to create plasma 82. In this example, current $_{RF}$-110 induces current $I_{induced}$-112 in gas 80 in an equal and opposite direction to current $I_{RF}$-110. Current $I_{induced}$-112 in gas 80 causes electrons in gas 80, e.g., electron 114, to collide with propellant or gas atoms, e.g., gas atom 116, to create positively charged ions to form plasma. For example, the collision of electron 114 with gas atom 116 strips one or more of the electrons 111 from gas atom 116 to create positively charged ion 118 that ionizes gas 80 to form plasma 82. Positively charged ion 118, FIG. 3, is then rapidly accelerated from plasma accelerator 72 due to axial electric field 100, as shown at 120, to provide ion flux. Electrons 88-94 emitted from cathode 86 neutralize the ion flux emitted from plasma accelerator 72.

Preferably, the DC voltages provided by DC power source 84 and the RF power provided by RF power source 106 are adjusted to selectively control the ionization and acceleration of the ions to optimize the performance of system 70 for a given mission by decoupling ionization of the gas from acceleration of the ions. This broadens the operating envelope of system 70 and allows efficient operation and high thrust-to-power ratio at both low and high Isp. For example, the RF power provided by RF power source 106 can be adjusted so that most of the ionization of gas 80 to form plasma is provided by the electrode, e.g., coil 104 and the DC voltage provided by DC power source 84 is adjusted to control most of the acceleration of the ions. Preferably, most of the ionization occurs in the first stage 111 of plasma accelerator 72 and most of the acceleration occurs in the second stage 113 of plasma accelerator 72. The result is system 70 effectively decouples ionization and acceleration. This allows system 70 to separately control the energy level of the ions and the ion flux density of the plasma. Because system 70 can be optimized to no longer depend on the DC voltages provided by the DC source 84 for ionization, system 70 can provide plasma at a constant ion flux density at low DC voltage or when the DC voltages provided by DC power source 84 vary by increasing the RF power provided by RF power source 106. In one example, system 70 provides low energy ions in the ion flux at a DC voltage as low as about 10 V DC while maintaining a constant high ion flux density of plasma at about $3\times10^{16}$ (number of ions/s/cm$^2$). Following neutralization, the low energy ions at high ion flux density are useful for simulating the particle flux and particle energy of an atmosphere at low altitude orbit, e.g., the energy level and flux of atomic oxygen in low earth orbit atmosphere. System 70 can also provide mid energy level ions, e.g., ions at an energy level of about 50 to 100 eV at a constant high ion flux density that can be used in semiconductor processes, such as etching, and the like. As discussed below, system 70 can provide ions with a narrow spread of energy levels so that surrounding materials in the etching process are not damaged.

Preferably, magnetic circuit structure 96 includes one or more electrically resistive material 180 (shown in phantom), e.g. ferrite or a similar type material, for minimizing coupling of the RF power provided by RF power source into magnetic circuit structure 96. In one design, magnetic circuit structure 96 is segmented in the radial direction located as indicated by 182 to minimize RF power losses. Magnetic circuit structure 96 may also be coated or clad by at least one layer of highly conductive material 184 (shown in phantom), e.g., silver or similar materials, for minimizing RF power losses.

Figure 5:
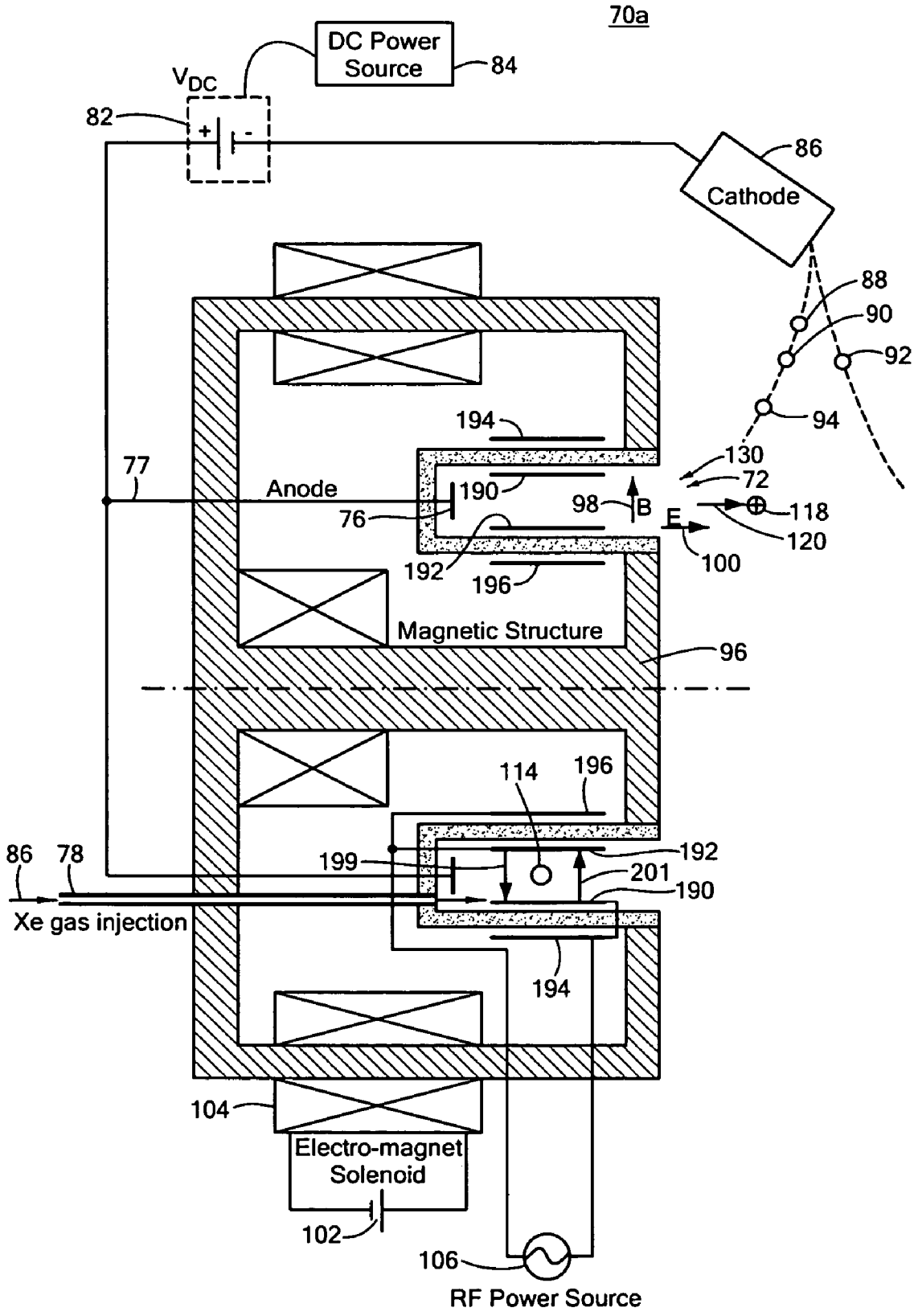
FIG. 5 is a schematic side view of another embodiment of the combined radio frequency and Hall Effect ion source and plasma accelerator system of this invention.

In one embodiment, combined radio frequency and Hall Effect ion source and plasma accelerator system 70*a*, FIG. 5, where like parts have been given like numbers, includes RF power source 106 that provides power to at least one electrode that in this embodiment includes capacitive plates, e.g., capacitive plates 190 and 192 disposed inside plasma accelerator 72 and/or capacitive plates 194 and 196 disposed about plasma accelerator 72. In this design, the power provided by RF power source 106 alternatively charges plate 190 and/or plate 194 and with positive and negative voltages while plate 192 and/or plate 196 is charged to the opposite voltage, e.g., when plate 190 is positively charged, plate 192 is negatively charged. When plate 190 and/or plate 194 is positively charged, electrons in gas 80 inside plasma accelerator 72, e.g., electron 114, is moving toward to the positively charged plate, as shown by arrow 199. Similarly, when plate 192 and/or plate 196 is positively charged, electron 114 is moving to plate 192 and/or plate 196, as shown by arrow 201. The oscillating movement of the electrons toward the positively charged plate causes the electrons to collide with gas atoms in plasma accelerator 72. The collision strips one or more of the electrons from the gas atom to create positively charged ions and create plasma similar as described above.

In other examples, the RF power provided by RF power source 106 may be coupled to the plasma by electron cyclotron resonance, as known by those skilled in the art.

Figure 6:
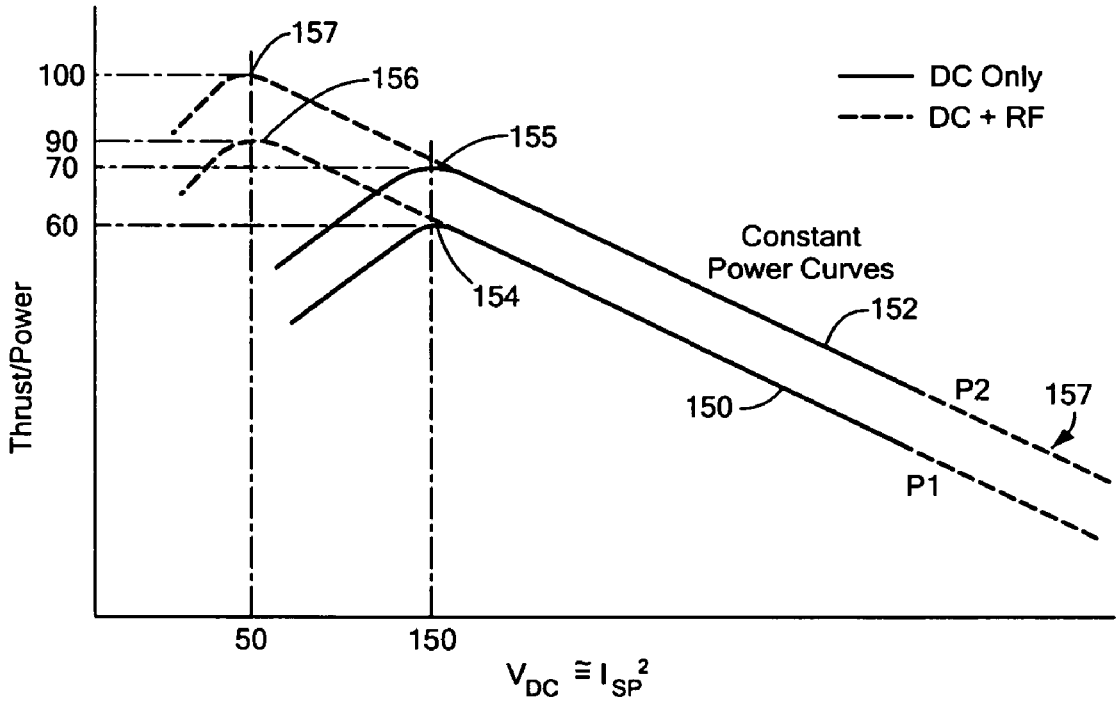
FIG. 6 is a graph showing an example of thrust/power vs. DC voltage for the combined radio frequency and Hall Effect ion source and plasma accelerator system shown in FIG. 3 compared to a conventional Hall Effect ion source and plasma accelerator system.

Independently controlling the DC voltage provided by DC power source 84 to determine the strength of axial electric field 100 and the acceleration and energy level of ions in the ion flux emitted from plasma accelerator 72 and the RF power provided by RF power source 106 to determine the amount of ionization allows system 70 increases the thrust to power ratio provided by system 70 at low DC voltages. FIG. 6 shows an example of the improved thrust to power of system 70 at a low DC voltage when compared to a conventional Hall Effect ion source and plasma accelerator system. In this example, two exemplary power curves, $P_1$ and $P_2$, are shown by curves 150 and 152, respectively. A typical prior art Hall Effect ion source and plasma accelerator system as described above provides a maximum thrust to power ratio of about 60 to 70 mN/kW, indicated at 154, and 155, respectively at a DC voltage of about 150 V DC. In contrast, combined radio frequency and Hall Effect ion source and plasma accelerator system 70 of this invention provides a maximum thrust to power ratio of about 90 to 100 mN/kW, indicated at 156, and 157, respectively, at DC voltages as low as about 50-100 V DC, while providing an $I_{sp}$ of about 700 to 1000 seconds.

Because ionization can be selectively controlled by adjusting the RF power provided RF power source 106, FIGS. 3-5, so that most of the ionization is provided by the electrode, e.g., coil 104, FIG. 3, or capacitive plates 190, 192 and/or 194, 196, FIG. 5, disposed about and/or inside plasma accelerator 72 to create the plasma, the problems associated with arcs forming near region 130 of plasma accelerator 72 at high DC voltages are eliminated. This allows system 70 to increase the maximum DC voltages that can be utilized to increase the maximum specific impulse. An example of the increased maximum specific impulse, e.g., about 7000 to 8000 seconds, achieved by system 70 of this invention is indicated by region 157, FIG. 6, on curves 150 and 152.

When the ion flux provided by system 70 is used in thruster applications, system 70 can provide two modes of operation. In one mode, e.g., a "DC+RF mode," a combination of the DC power provided by DC power source 84 to accelerate the ions and the RF power provided by RF power source 106 for ionization are tuned so that a high thrust to power ratio is achieved at a lower $I_{sp}$ and at lower DC voltages. The thrust to power ratio and $I_{sp}$ are governed by the equation:

$$\left(\frac{T}{P}\right) = \frac{2\eta}{I_{sp}g_0} \tag{1}$$

where T is the thrust, P is power, η is efficiency, $g_0$ is gravity at sea level. Therefore, increasing the $I_{sp}$ reduces the available thrust to power ratio. However, because system 70 can use the RF power provided by RF power source 106 to increase ionization and ion flux system 70 can increase the thrust to power ratio at a lower $I_{sp}$ when compared to conventional Hall Effect ion source systems. The DC+RF Mode is useful when a spacecraft or similar vehicle needs to maneuver quickly, e.g., to change its location in orbit.

In another mode, e.g., a "DC mode," system 70 relies on the DC voltages provided by DC power source 84 for both ionization and acceleration. In this mode, a lower the thrust to power ratio is achieved but the $I_{sp}$ is significantly increased. Increasing the $I_{sp}$ allows a satellite or similar vehicle to run for extended periods of time on limited propellant. As discussed above, system 70 can increase the maximum DC voltage that can be utilized and therefore the maximum $I_{sp}$ that can be achieved.

Figure 7:
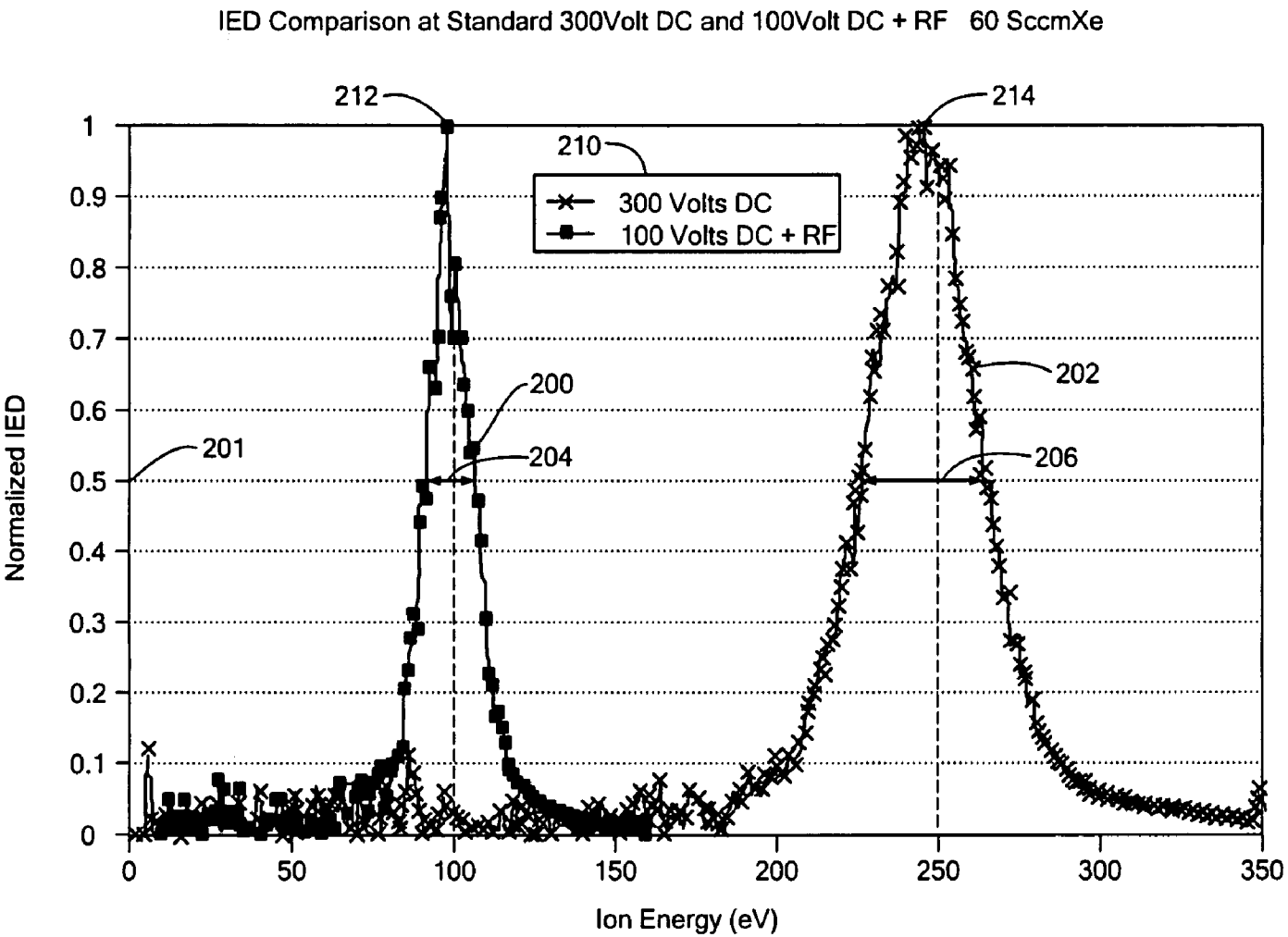
FIG. 7 is a graph showing examples of normalized ion energy distribution vs. ion energy level for the combined radio frequency and Hall Effect ion source and plasma accelerator system shown in FIGS. 3 and 5.

When system 70 operates in the DC+RF mode, virtually all the DC voltages provided by DC power source 84 connected to electric circuit 82 are used to accelerate the ions and define the energy level of the ions. Similarly, virtually all the RF power provided by RF power source 106 is used for ionization. The result is that the ion energy distribution ($I_{ED}$) of the ions in the plasma will have a very narrow spread of energy levels when compared to system 70 operating in the DC mode. Curve 200, FIG. 7, shows an example system 70 operating in the DC+RF mode and curve 202 shows an example of system 70 operating in the DC mode. At 0.5 normalized $I_{ED}$, indicated at 201, the energy spread of the ions generated by system 70 operating in the DC+RF mode, indicated at 204, is significantly less than the energy spread of the ions generated by system 70 operating in the DC mode, indicated at 206. The mono-energetic beam indicates high efficiency where no DC voltage is wasted on ionization, as discussed below. As discussed above, maintaining a narrow energy spread of ions in the ion flux is useful in semiconductor processes to provide for optimum etching and while preventing damage to surfaces and materials that do not need to be etched. In other examples, a narrow spread of energy levels of the ions in ion flux provided by system 70 can be used to simulate the atomic oxygen flux and energy level of an atmosphere at low altitude orbit, e.g., the low earth orbit atmosphere that typically includes atomic oxygen.

The DC+RF mode of system 70, FIGS. 3 and 5, also improves the efficiency because there are virtually no DC voltage losses. Curve 200, FIG. 7, represents an example of the operation of system 70 in the DC+RF mode in which 100 V DC, is provided by DC power source 84 and an appropriate amount of RF power is provided by RF power source 106 for ionization, indicated by caption box 210. Curve 202 represents an example of system 70 operating in the DC mode in which 300 V DC, indicated by caption box 210, is provided by the DC power source 84. In this example, peak 212 for curve 200 is at about 100 eV and peak 214 for curve 202 is at about 250 eV. A peak ion energy level of 100 eV at a DC voltage of 100 V DC means the ions are accelerated to an energy level very close to the applied DC voltage. The result is system 70 operates at virtually 100% efficiency in terms of the DC voltage provided by the DC power source 84 in the DC+RF mode. This is because virtually all the DC voltage provided by DC power source 84 is used for acceleration of the ions. In contrast, as shown by curve 202, when system 70 operates in the DC mode, an ion energy level of only 250 eV is achieved when 300 V DC is applied by the DC power source. A 50 eV loss in the energy level of the ions represents a 50 eV loss in the efficiency of system 70. The 50V DC loss in the DC mode is caused in part because the DC mode relies on the DC voltage for the ionization process. Anode and wall loses also contribute to the DC loss.

Although when operating in the DC+RF mode, system 70 requires additional RF power for ionization, this RF power requirement is offset by the improved DC efficiency. At lower DC voltages, adding RF power to the plasma energizes the electrons to a higher energy level to increase ionization efficiency. Therefore, system 70 can operate in the DC+RF mode while increasing the overall efficiency and achieving higher thrust-to-total power (DC+RF) ratio.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A combined radio frequency (RF) and Hall Effect ion source and plasma accelerator system comprising:

a plasma accelerator including an anode and a discharge zone, said plasma accelerator for providing plasma discharge;

a gas distributor for introducing a gas into the plasma accelerator;

a cathode for emitting electrons attracted to the anode and for neutralizing ion flux emitted from the plasma accelerator;

an electrical circuit coupled between the anode and the cathode having a DC power source for providing DC voltage;

a magnetic circuit structure including a magnetic field source for establishing a transverse magnetic field in said plasma accelerator that creates an impedance to the flow of the electrons toward said anode to enhance ionization of the gas to create plasma and which in combination with said electric circuit establishes an axial electric field in said plasma accelerator; and an RF power source for providing RF power to at least one electrode disposed about and/or inside said plasma accelerator that induces current for ionizing the gas to create the plasma such that said axial electric field accelerates ions through said plasma accelerator to provide ion flux.

2. The system of claim 1 in which the DC voltage provided by the DC power source and RF power provided by the RF power source are adjusted to selectively control the amount of ionization and acceleration of the plasma.

3. The system of claim 1 in which ionization and acceleration of the plasma is optimized by controlling the RF power provided by the RF power source and/or the DC voltage provided by the DC power source.

4. The system of claim 1 in which the DC voltage provided by the DC power source is adjusted to control acceleration of the ions.

5. The system of claim 1 in which the DC voltage provided by the DC power source and the RF power provided by the RF power source are adjusted to decouple ionization of the gas from acceleration of the ions.

6. The system of claim 1 in which the DC voltage generated by the DC power source and RF power provided by RF power source are adjusted to selectively control the energy level of ions and the ion flux density of the plasma.

7. The system of claim 1 in which the RF power source provides RF power that is coupled to the plasma inductively and/or capacitively.

8. The system of claim 1 in which the RF power source provides RF power that is coupled to the plasma by electron cyclotron resonance.

9. The system of claim 1 in which the plasma accelerator includes at least first and second stages wherein first stage is powered by the RF power source and the second stage is powered the DC power source such that most of the ionization occurs in the first stage and most of the acceleration occurs in the second stage.

10. The system of claim 1 in which said at least one electrode includes a coil and/or capacitive plates.

11. The system of claim 1 in which the magnetic circuit structure includes a least one electrically resistive material for minimizing coupling of the RF power into the magnetic circuit structure.

12. The system of claim 1 in which said magnetic circuit structure is segmented to minimize RF power losses.

13. The system of claim 1 in which said magnetic circuit structure includes at least one layer of highly conductive material for minimizing RF power losses.

14. The system of claim 1 in which the axial electric field accelerates the ions in said plasma accelerator to create thrust.

15. The system of claim 1 in which the DC voltage provided by the DC source and the RF power provided by the RF power source are adjusted to increase thrust to the power ratio.

16. The system of claim 1 in which the DC voltage provided by the DC power source and the RF power provided by the RF power source are adjusted to increase specific impulse.

17. The system of claim 1 in which the DC voltage provided by the DC power source and the RF power provided by the RF power source are adjusted to provide a specific impulse of about 1000 seconds at DC voltages of about 100 V DC while delivering a thrust to power ratio of about 0.1N/kW.

18. The system of claim 1 in which the DC voltage provided by the DC power source and the RF power provided by the RF power source are adjusted to provide low to mid energy level ions at high ion flux density.

19. The system of claim 18 in which the low energy ions at said high ionic flux density used to simulate particle flux and energy level of an atmosphere at low altitude orbit.

20. The system of claim 19 in which said atmosphere at low altitude orbit includes low earth orbit atmosphere.

21. The system of claim 20 in which said low earth orbit atmosphere includes atomic oxygen.

22. The system of claim 18 in which the low to mid energy level ions provided at the high ionic flux density are used for semiconductor processing.

* * * * *